US012114692B2

(12) United States Patent
Hagen

(10) Patent No.: US 12,114,692 B2
(45) Date of Patent: Oct. 15, 2024

(54) WATER PIPE HAVING A MECHANISM FOR RELEASING SPENT CAPSULES

(71) Applicant: AIR IP HOLDINGS LIMITED, Dubai (AE)

(72) Inventor: Klaus Hagen, Haren (DE)

(73) Assignee: AIR IP HOLDINGS LIMITED, Dubai (AE)

( * ) Notice: Subject to any disclaimer, the term of this patent is extended or adjusted under 35 U.S.C. 154(b) by 645 days.

(21) Appl. No.: 17/252,371

(22) PCT Filed: Jun. 15, 2018

(86) PCT No.: PCT/DE2018/100564

§ 371 (c)(1),
(2) Date: Dec. 15, 2020

(87) PCT Pub. No.: WO2019/238149

PCT Pub. Date: Dec. 19, 2019

(65) Prior Publication Data

US 2021/0186090 A1 Jun. 24, 2021

(51) Int. Cl.

| | |
|---|---|
| ***A24F 1/30*** | (2006.01) |
| ***A24D 1/14*** | (2006.01) |
| ***A24F 40/20*** | (2020.01) |
| ***A24F 40/42*** | (2020.01) |
| ***A24F 40/485*** | (2020.01) |
| ***A24F 40/50*** | (2020.01) |

(52) U.S. Cl.

CPC ..... *A24F 1/30* (2013.01); *A24D 1/14* (2013.01); *A24F 40/20* (2020.01); *A24F 40/42* (2020.01); *A24F 40/485* (2020.01); *A24F 40/50* (2020.01)

(58) Field of Classification Search

CPC ..... A24F 40/20; A24F 40/42; A24F 40/50; A24F 40/485; A24F 1/30; A24D 1/14

USPC ..... 131/329

See application file for complete search history.

(56) References Cited

U.S. PATENT DOCUMENTS

| | | | | |
|---|---|---|---|---|
| 3,402,723 | A | 9/1968 | Yow-Jiun | |
| 3,918,464 | A | 11/1975 | Kolodziej | |
| 4,031,906 | A | 6/1977 | Knapp | |
| 4,133,318 | A | 1/1979 | Gross et al. | |
| 4,788,988 | A * | 12/1988 | Titus | A24F 1/30 131/191 |
| 7,287,530 | B1 | 10/2007 | Stuart | |
| 7,775,218 | B2 | 8/2010 | Shraiber | |
| 8,347,892 | B2 | 1/2013 | Mehio | |

(Continued)

FOREIGN PATENT DOCUMENTS

| | | |
|---|---|---|
| CA | 2599199 A1 | 2/2009 |
| CN | 201303930 Y | 9/2009 |

(Continued)

*Primary Examiner* — Peter G Leigh
(74) *Attorney, Agent, or Firm* — Hayes Soloway PC

(57) ABSTRACT

A water pipe (1) comprises a housing (2) into which a receptacle (3), which has at least one suction connection (6) and which can be filled with a liquid medium, and a heating chamber (4), which is connected to the receptacle via a suction hose (6), are integrated. The heating chamber (4) comprises a receiving portion (5) for a capsule (10) which holds a smoking medium. The spent capsule (10) can be ejected from its seat in the receiving portion (5) in the direction of the receptacle (3) by means of a mechanism.

17 Claims, 7 Drawing Sheets

(56) References Cited

U.S. PATENT DOCUMENTS

Figure 1:
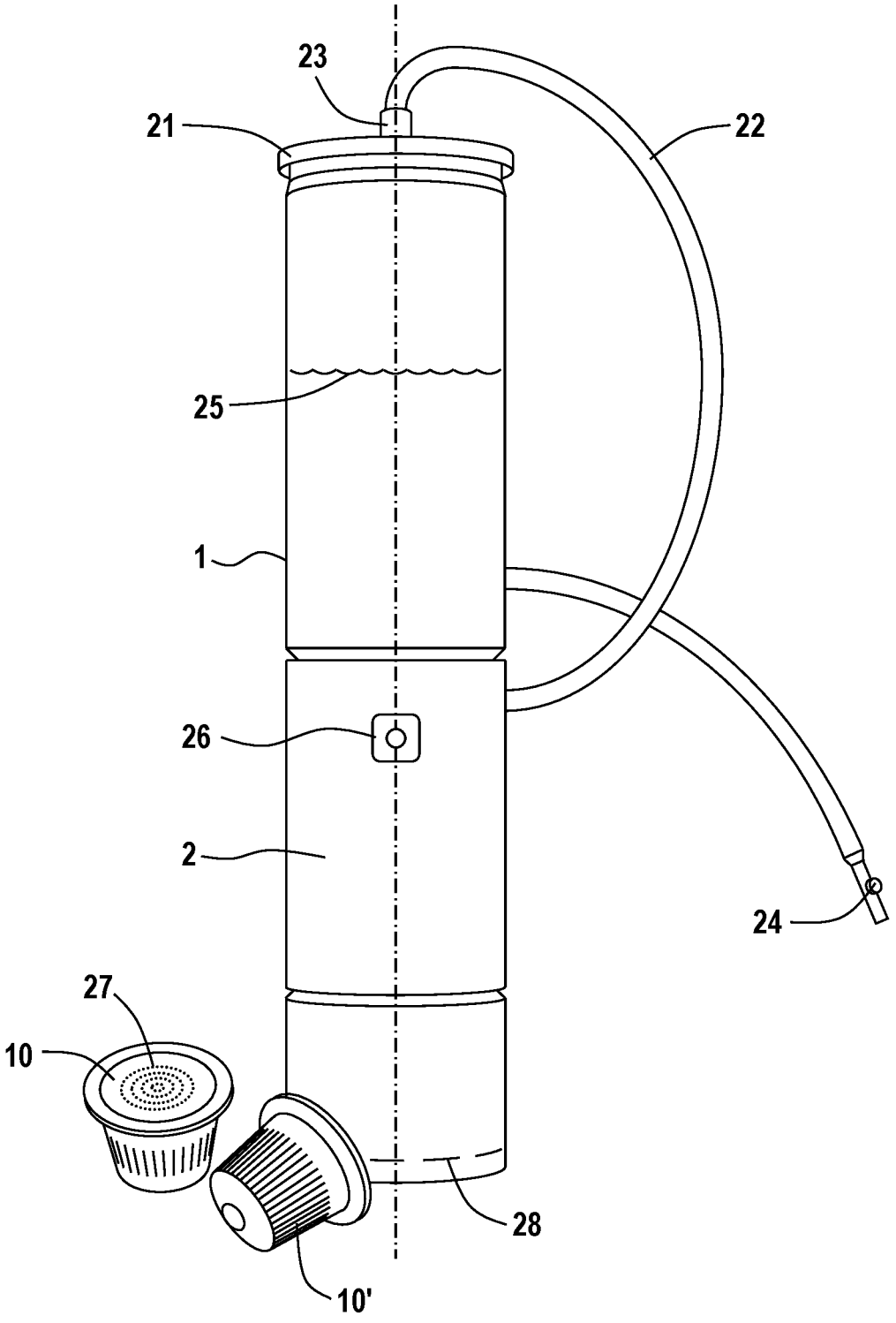

| | | | |
|---|---|---|---|
| 8,464,725 | B2 | 6/2013 | Badawi |
| 8,550,091 | B2 | 10/2013 | Yomtov |
| 2005/0279371 | A1 | 12/2005 | Billard et al. |
| 2006/0086364 | A1 | 4/2006 | Liu et al. |
| 2006/0086365 | A1 | 4/2006 | Liu et al. |
| 2007/0056599 | A1 | 3/2007 | Zoumut et al. |
| 2008/0060663 | A1 | 3/2008 | Hamade et al. |
| 2009/0084391 | A1 | 4/2009 | Krupp et al. |
| 2009/0151717 | A1 | 6/2009 | Bowen et al. |
| 2010/0025057 | A1 | 2/2010 | Andersson et al. |
| 2010/0083973 | A1 | 4/2010 | Zoumut |
| 2010/0126516 | A1 | 5/2010 | Yomtov et al. |
| 2010/0186091 | A1 | 7/2010 | Turner et al. |
| 2010/0212679 | A1 | 8/2010 | Bishara et al. |
| 2010/0263681 | A1 | 10/2010 | Zhao et al. |
| 2011/0180080 | A1 | 7/2011 | Fares et al. |
| 2011/0186059 | A1 | 8/2011 | Mouhanna et al. |
| 2011/0186060 | A1 | 8/2011 | Saleh et al. |
| 2012/0042884 | A1 | 2/2012 | Mukaddam |
| 2012/0067357 | A1 | 3/2012 | Boutros et al. |
| 2012/0199572 | A1 | 8/2012 | Shen et al. |
| 2013/0199547 | A1 | 8/2013 | Popmarkov et al. |
| 2014/0060554 | A1 | 3/2014 | Collett et al. |
| 2014/0069446 | A1 | 3/2014 | Haddad et al. |
| 2014/0230832 | A1 | 8/2014 | Saliman et al. |
| 2015/0053221 | A1 | 2/2015 | Asghar-Sheikh et al. |
| 2016/0106154 | A1* | 4/2016 | Lord ..... A24F 40/485 392/395 |
| 2016/0106155 | A1* | 4/2016 | Reevell ..... H05B 1/0297 131/329 |
| 2016/0206001 | A1 | 7/2016 | Eng et al. |
| 2016/0235122 | A1 | 8/2016 | Krietzmas et al. |
| 2017/0099873 | A1* | 4/2017 | Benjamignan ..... H01M 10/425 |
| 2017/0172203 | A1* | 6/2017 | Gebara ..... A24D 1/14 |
| 2017/0251718 | A1* | 9/2017 | Armoush ..... A24F 40/40 |
| 2018/0271150 | A1 | 9/2018 | Sparklin et al. |
| 2021/0186090 | A1 | 6/2021 | Hagen |
| 2021/0186091 | A1 | 6/2021 | Hagen et al. |
| 2021/0267272 | A1 | 9/2021 | Hagen et al. |

FOREIGN PATENT DOCUMENTS

| | | | |
|---|---|---|---|
| CN | 201336930 | Y | 11/2009 |
| CN | 202276825 | U | 6/2012 |
| CN | 103653244 | A | 3/2014 |
| CN | 104055225 | A | 9/2014 |
| CN | 104522890 | B | 9/2017 |
| CN | 112930122 | A | 6/2021 |
| CN | 112930123 | A | 6/2021 |
| DE | 498312 | C | 5/1930 |
| DE | 202005015795 | U1 | 12/2005 |
| DE | 202008010123 | U1 | 4/2009 |
| DE | 102014005884 | A1 | 10/2015 |
| DE | 102015121435 | A1 | 5/2017 |
| EP | 2292108 | A1 | 3/2011 |
| EP | 2422633 | A1 | 2/2012 |
| EP | 2179967 | B1 | 4/2012 |
| FR | 3019989 | B1 | 10/2015 |
| GB | 2553773 | A | 3/2018 |
| WO | 2013001272 | A1 | 1/2013 |
| WO | 2013057185 | A1 | 4/2013 |
| WO | 2014012216 | A1 | 1/2014 |
| WO | 2014118787 | A1 | 8/2014 |
| WO | 2015172224 | A1 | 11/2015 |
| WO | 2017080545 | A1 | 5/2017 |

* cited by examiner

WATER PIPE HAVING A MECHANISM FOR RELEASING SPENT CAPSULES

CROSS-REFERENCE TO RELATED APPLICATIONS AND PRIORITY

This patent application claims priority from PCT Patent Application No. PCT/DE2018/100564 filed Jun. 15, 2018. This patent application is herein incorporated by reference in its entirety.

The invention concerns a water pipe with a housing into which a receptacle intended to be filled with a liquid medium and equipped with at least one suction connection, and a heating chamber which is connected to the receptacle via a suction hose are integrated, whereby the heating chamber comprises a receiving portion for a capsule serving to hold a smoking medium.

Water pipes, also called shishas or hookahs, originate from the orient. Such water pipes are known from U.S. Pat. No. 4,031,906 or US 2012/0042884, among others. They are enjoying increasing popularity, especially among young people and adolescents, and particularly as an alternative to cigarettes. Such a water pipe has a receptacle designed to be partly filled with water or another liquid medium. Suction at a mouthpiece creates a reduced pressure in this receptacle. Extending a distance into the water, there is also a smoke column having at its upper end a top section to hold tobacco that is heated by charcoal resting on top of it. The mixture of air, vapour and smoke particles formed by heating the tobacco is then taken in by the smoker. In this respect, it is obvious that carbon monoxide poisoning, an accidental burn or in an extreme case even an outbreak of fire can occur due to heating by the glowing charcoal. The qualitative and legally compliant equipping of a shisha is not ensured due to its manual filling. In principle, therefore, the shishas known today should be operated only out of doors or in rooms with a guaranteed supply of fresh air. Moreover, shishas constructed according to the state of the art are quite heavy and voluminous, need to be assembled from several components, and are inconvenient to transport in their individual components.

Electronic shishas are known from U.S. Pat. No. 4,133,318 or U.S. Ser. No. 12/0,199,572, through which a few of the aforementioned problems can be reduced, although not yet satisfactorily. Finally, the subject of WO 2017/080545 is an electronic shisha in which a capsule to hold a solid or liquid smoking medium is put into a receiving portion that is part of the apparatus. This receiving portion comprises a wall part narrowing towards the receptacle and enclosing the capsule at the sides, whereby the receiving portion is designed as a heating element for the capsule at the same time. Conventional removal of shisha capsules heated to up to 200° C. has proved to be dangerous, especially as it is associated with a great danger of burns. Moreover, removal is also difficult because the capsule raw material expands during the heating phase, and shrinks back to normal size only after it has thoroughly cooled down. However, even capsules that have cooled down are comparatively difficult to remove because the capsule grips against the shoulder that is intended as an end-stop for the capsule, and has to be pulled out of the receiving portion. Last but not least, all of this is laborious.

Thus the task of the present invention is to create a water pipe with which the spent capsules can be easily removed from the heating chamber and/or receiving portion.

The task is solved by a mechanism to eject the spent capsule out of its seat in the receiving portion in a direction opposite to its insertion direction.

Due to this mechanism, spent capsules can be ejected from their seat in the receiving portion on the heating compartment side without the user coming into contact with parts of the water pipe or capsule that are possibly exposed to high temperatures. Such health impairments due to the high temperatures of up to 200° C. that heated shisha capsules can assume are thereby excluded, as is the jamming of the capsule when being pulled out.

Any possible expansion processes of the capsule are also negligible, since the latter can be ejected from the receiving portion particularly effectively from the receptacle direction.

The fact that the mechanism is operable from outside of the heating chamber is aimed in this same direction, namely good handling and the creation of an adequate distance between the operator's hand and the heating chamber and/or the capsule situated therein, e.g. to exclude burns.

In this respect, an advantageous embodiment of the invention provides for the suction hose to be supported slidably in the direction of its longitudinal axis. This is a particularly optimum solution for a mechanism of this kind, in the sense that the suction hose that is present in any case is given an additional function, namely to act as a mechanism to eject the capsules. Indeed, this takes place from a completely non-hazardous distance relative to the high temperature of the spent capsules in the heating chamber. Simply pressing the suction hose exerts a force on the capsule in a direction opposite to that in which the latter was inserted. Consequently, the capsule necessarily releases from its seat in the receiving portion on the heating chamber side and can easily be picked up.

For even better handling, the intention is for the suction hose to be slidably supported against the force of a spring, so the suction hose returns to its initial position after being used to release the capsule, and the free play of the suction hose during operation is limited.

The proposal according to which the suction hose displays two sections with different diameters is also understood in this sense. It results in the formation of a spring shaft for the suction hose or another mechanism.

The arrangement of an inner tube with two sections of different diameter in front of the suction hose is to be understood as an alternative to a single suction hose with two sections of different diameter.

For this purpose, the suction hose is assigned an inner tube that in turn exhibits the two sections of different diameter, so as to allow the use of a standard suction hose that operates the inner tube. Thus a first embodiment of the invention relates to a one-piece suction hose with two sections of different diameter, and a second embodiment relates to a suction hose plus an inner tube, whereby the latter has two sections of different diameters.

In this respect, it is then advantageous if the inner tube/hose section is surrounded by a compression spring, so the spring bearing is formed in this transitional region.

The appearance of this in concrete terms is that the tube section of the suction hose or inner tube facing towards the heating chamber has a diameter smaller than that of the outer tube section of the suction hose or inner tube facing towards the receptacle, thus forming a shoulder against which the spring acts when the suction hose is moved. This gradation or end-stop enables the compression of the spring when the suction hose is correspondingly operated to release the capsule, and its return to the initial position.

An especially suitable variant of the invention is implemented by integrating the spring shaft into the wall of the heating chamber facing towards the receptacle. The spring housing integrated into the wall thereby limits the free displacement of the spring.

The function of the suction hose or of another mechanism has already been discussed several times. Therefore, it is logical if the suction hose, in concrete terms the inner section of the hose or the inner tube extends into the heating chamber and, depending on pressure on the suction hose, slides further towards the interior of the heating chamber to finally enable the capsule to be pressed out of its seat in the receiving portion.

To complement this, there is provision for the suction hose and/or inner tube to be slidably supported in a guide bolt fixedly attached to the heating chamber. This sleeve-like guide bolt is attached to the heating chamber, more precisely to the wall facing towards the receptacle. In the installed condition, for example, this bolt is surrounded by the electronics unit and/or the controller for the hookah.

A further advantageous embodiment of the invention provides for the mechanism to be actuated manually and/or via the water pipe's electronic controller. The first, manual variant has already been comprehensively described, and in the case of the electronic controller as a second embodiment, the printed circuit board electronically controls a mechanism comparable to a compression die, which sets in motion the suction hose or a separate rod, which ultimately ejects the capsule from its seat.

The aim is to ensure highly efficient heat exchange between the heating chamber and the capsule inserted into it, which is enabled through the exactly fitting seating between the receiving portion or parts of this receiving portion on the one hand and the capsule on the other. The cone or taper is decisively important with regard to the exactly fitting seating. This allows particularly well-focused heat transfer due to an exactly fitting seating between the walls of the receiving portion surrounding the sides of the capsule and the capsule itself. Actually, the more firmly the capsule sits in the receiving portion, the more effectively the heat reaches it from the exterior, i.e. from the heating chamber towards the capsule. An especially advantageous variant for such an exactly fitting seating provides for the lateral wall of the receiving portion to taper conically towards the interior of the heating chamber, whereby the cone or taper has an angle of approx. 5°-10°, preferably of approx. 7°. An ideal geometry is achieved when the diameter of the receiving portion between the front and back of the receiving portion and capsule respectively increases constantly by a factor of about 1.1 to 1.25, preferably approx. 1.17.

According to one development of the invention, there is provision for the receiving portion to have at its outside a closure ring extending at right angles to the longitudinal axis of the housing and into which the receiving portion for the capsule is integrated, i.e. the closure ring and the heating chamber are arranged and shaped to correspond to one another in such a way that the closure ring has a central opening into which the capsule is seated in the receiving portion. At the same time, depending on the arrangement of the receptacle, heating chamber etc., the closure ring forms the upper or lower termination of the housing or heating chamber respectively. Moreover, the closure ring functions as an end stop for a collar on the capsule side when the capsule is inserted into the heating chamber. Thus the closure ring guarantees the capsule's seating in the heating chamber, not least in that the capsule has a collar by which it contacts against the closure ring.

Moreover, there is provision made for the receptacle and a part of the housing containing the electronic unit to be detachably connected together, and for a valve to be provided in the area of the suction hose's opening into the receptacle. The housing of the water pipe consists essentially of the receptacle as the first part of the housing, the second part of the housing containing the electronics and suction hose, and the third part of the housing accommodating the heating chamber for the capsule, expediently in the stated sequence from top to bottom. In this respect, the receptacle and the part of the housing accommodating the electronic unit are connected to one another detachably and additionally by a valve ensuring an additional seal, which safeguards the shisha according to the invention particularly effectively against the escape of bypass air. Preferably, the valve is arranged centrally thereto, and part of the same extends into the interior of the receptacle if necessary. The valve sits exactly fitting onto the suction hose extending upwards out of the housing portion. The suction hose, whose lower end opens into the heating chamber and passes through the housing portion, is connected exactly fitting to the valve at its lower end, so no bypass air can escape in this entire area. In concrete terms, this looks as if the suction hose opens into the receptacle base from below, whereby the base must be altogether of such massive design as to form a stable support here for the valve and the end of the pipe.

In this respect, an expedient embodiment of the invention is one in which the base of the receptacle has a hollow cavity with an integrated central attachment plate to fix the suction hose. Thus the attachment plate positioned centrally in the hollow cavity of the otherwise comparatively massive base serves as a support for the suction hose.

In particular, the invention is characterised in that an especially suitable mechanism is created to release spent but possibly still extremely hot capsules to hold a smoking medium from the heating chambers and/or receiving portions positioned there. Instead of using the hand, a knife etc. to awkwardly separate such a capsule from its seat in the receiving portion by pulling on the collar, the suction hose that is present in any case, or another rod-like structural element, is used in a double function to additionally enable the capsule to be pressed out of its seat in the receiving portion. For this purpose, the suction hose is slidably supported against the force of a spring, whereby the spring housing is integrated into the wall of the heating chamber facing towards the receptacle. An alternative to this mechanical solution presupposes a controller that ensures a corresponding movement of such a mechanism to press out the capsule.

Figure 2:
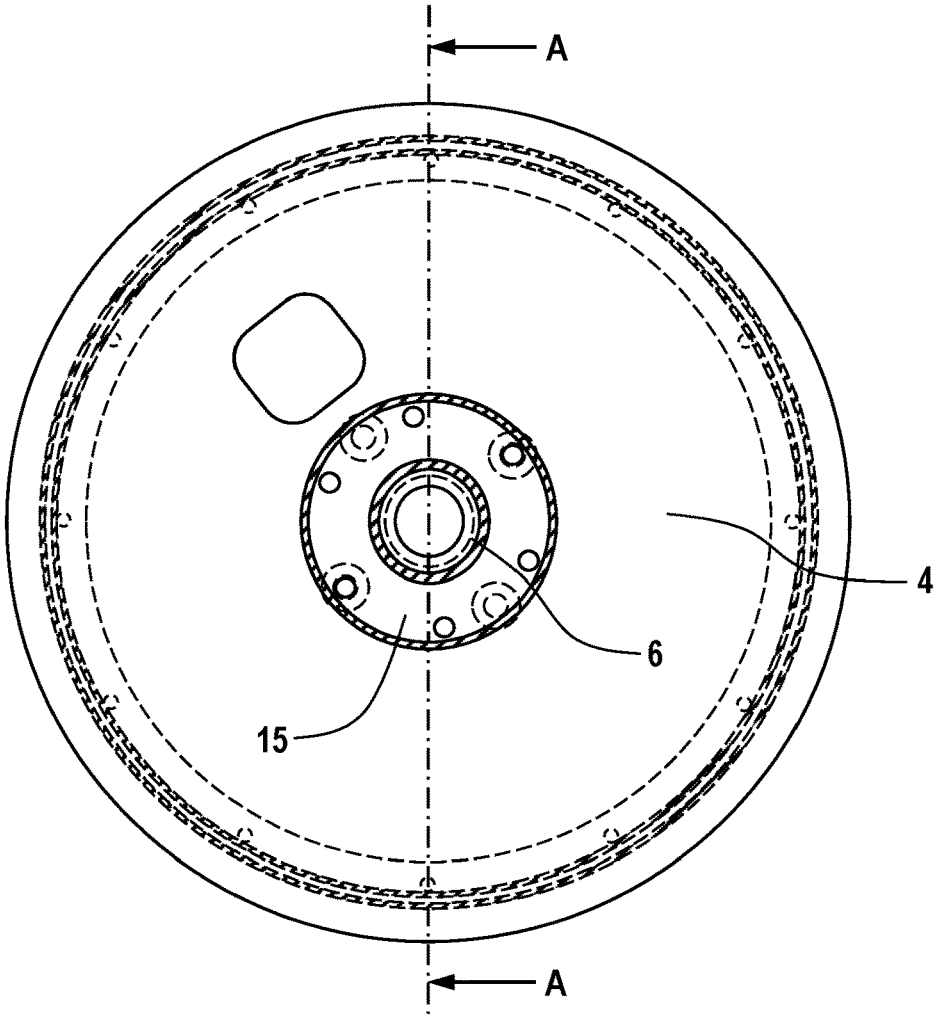
Figure 3:
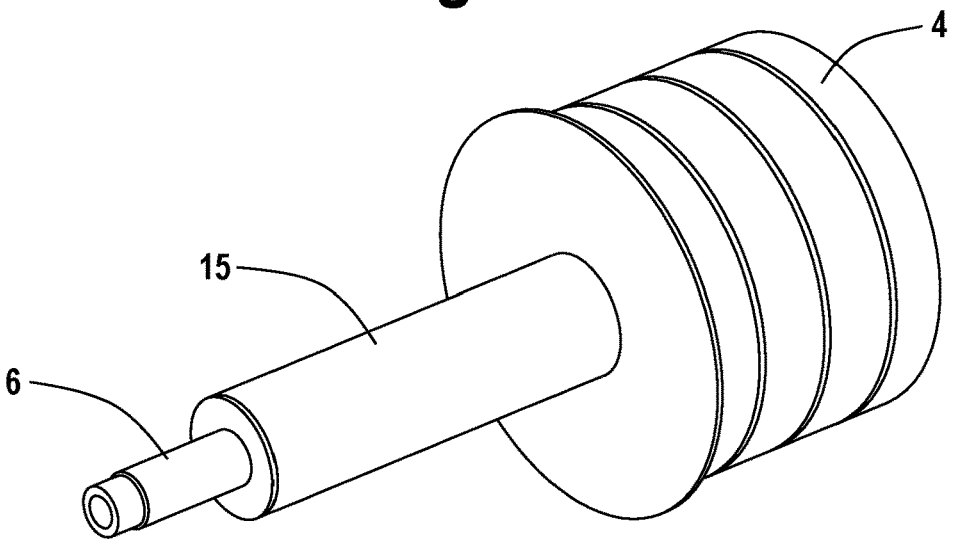
Figure 4:
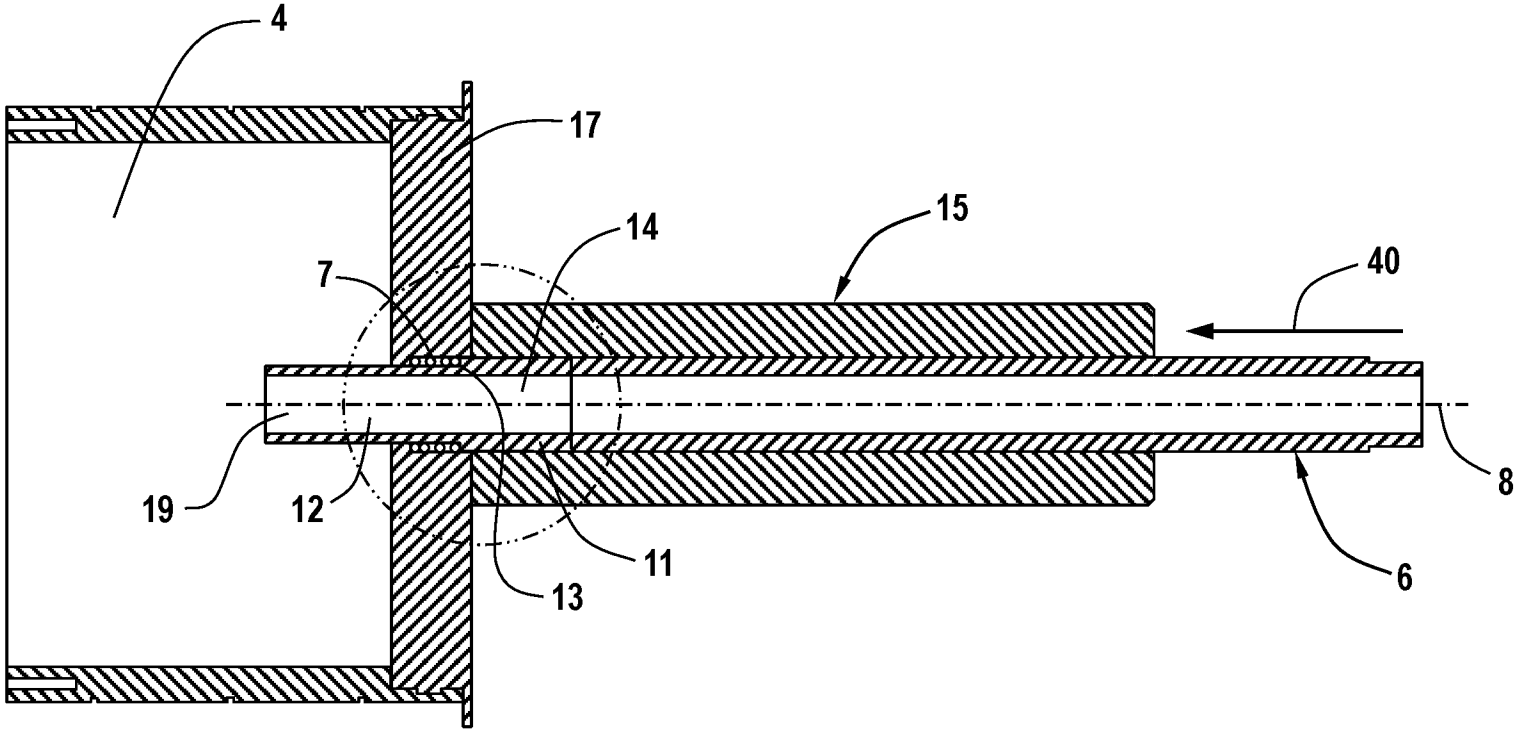
Figure 5:
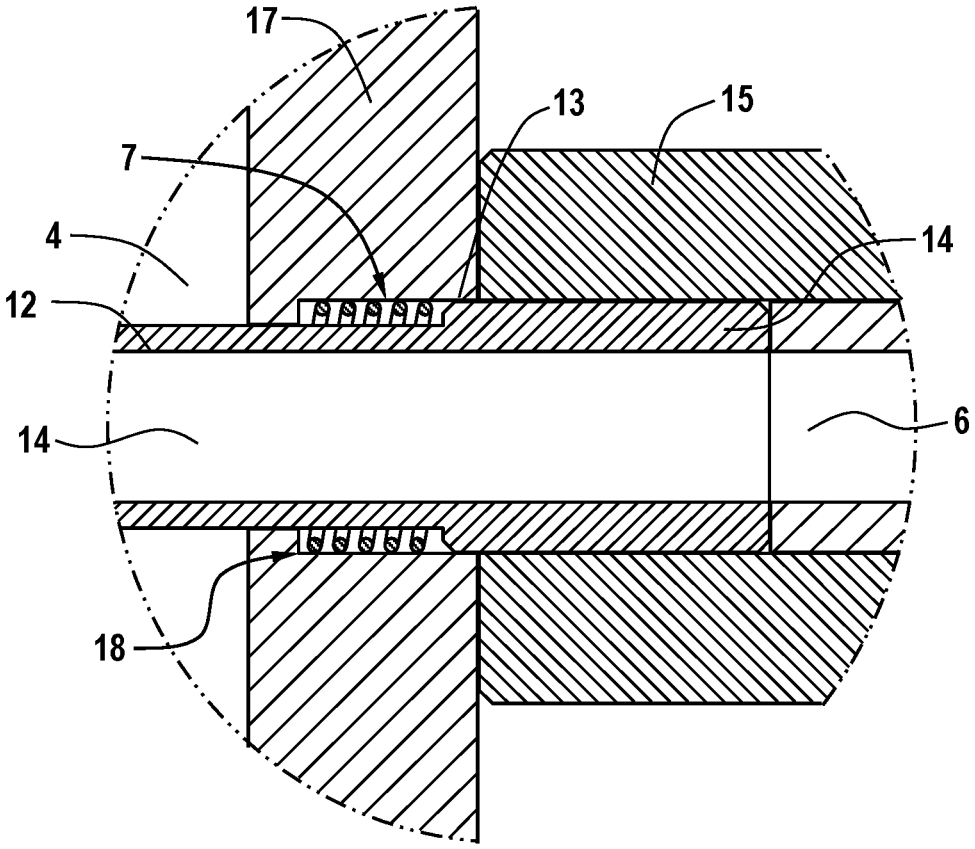
Figure 6:
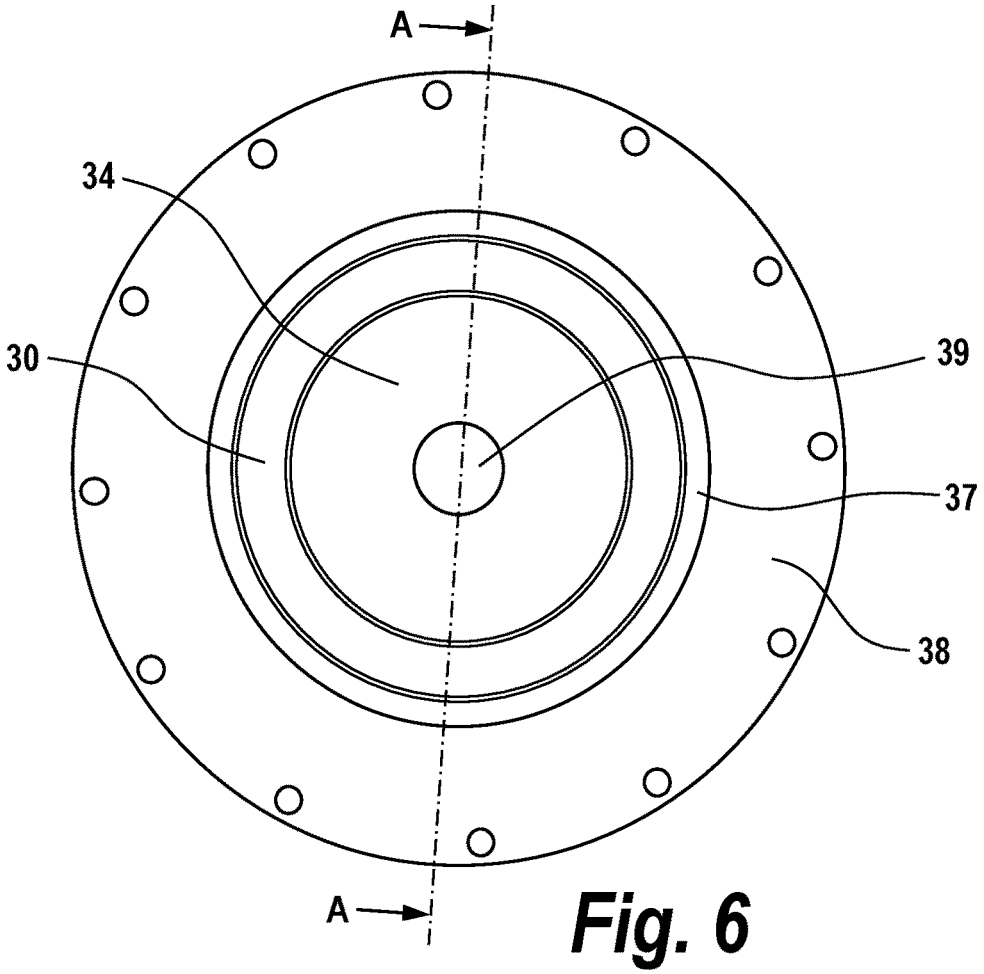
Figure 7:
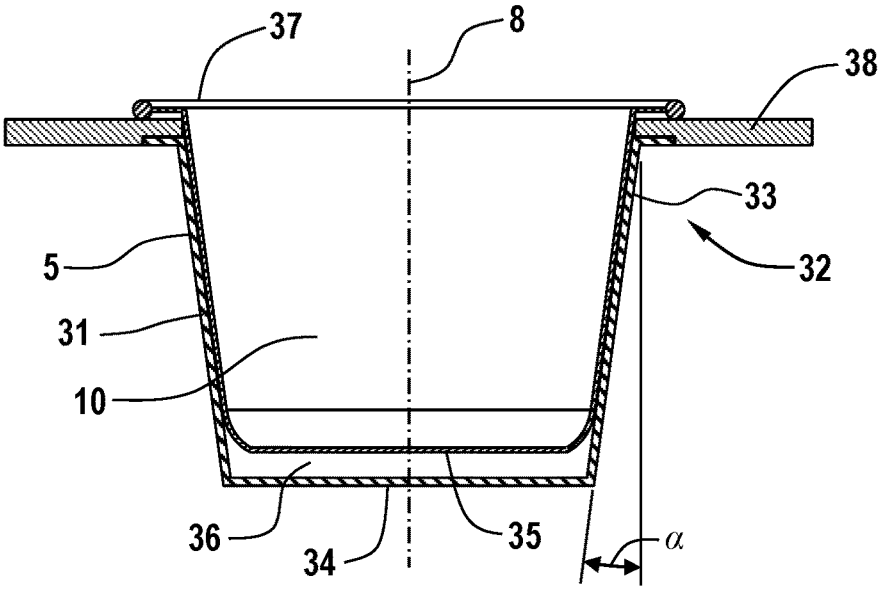
Figure 8:
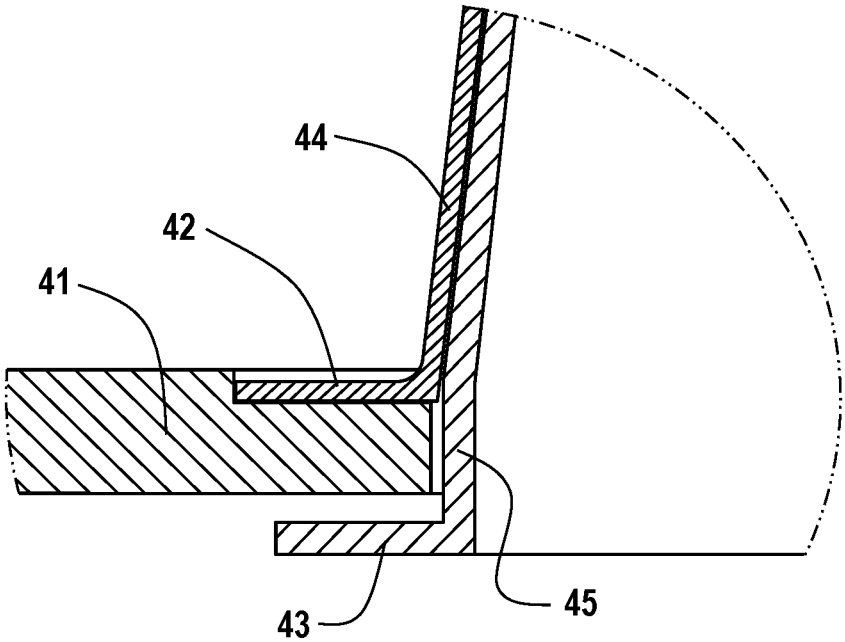
Figure 9:
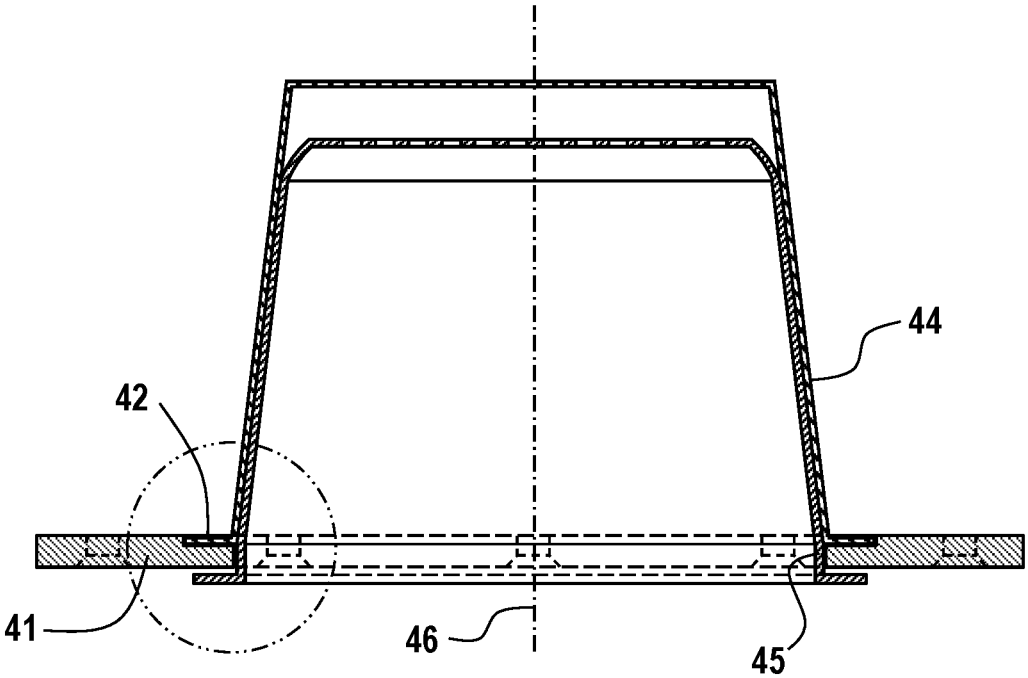
Figure 10:
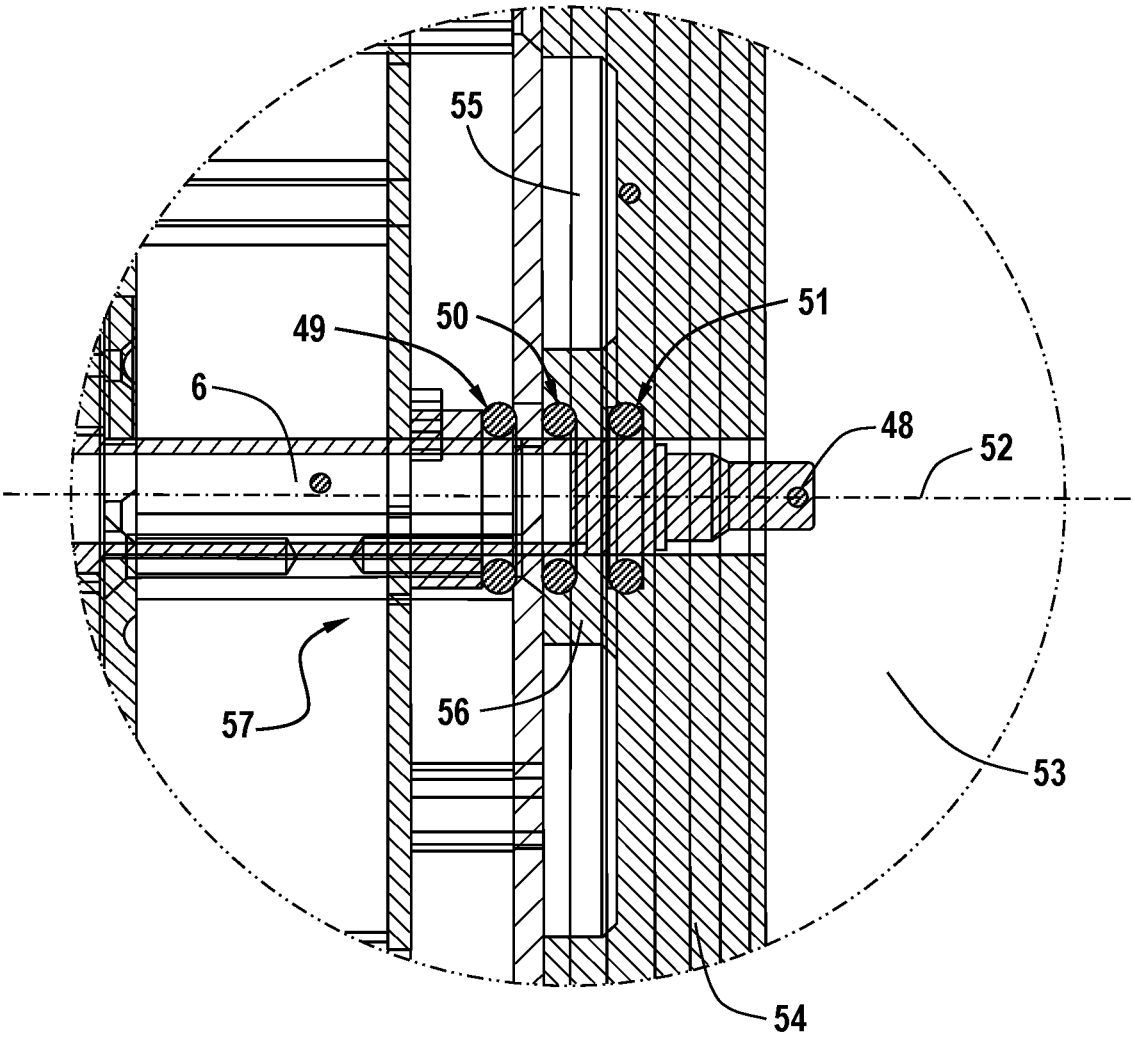

Further details and advantages of the subject matter of the invention arise from the following description of the associated Drawing, in which a preferred embodiment example is illustrated together with the details and individual parts necessary for this purpose. There are shown:

FIG. 1 an elevation view of a water pipe,

FIG. 2 a plan view of a heating chamber with suction hose,

FIG. 3 a perspective illustration relating to FIG. 2,

FIG. 4 a longitudinal cross-section through the heating chamber and suction hose, FIG. 5 a detail of FIG. 4, FIG. 6 a plan view of a receiving portion, FIG. 7 a receiving portion with a capsule inserted, FIG. 8 a detail of FIG. 9, FIG. 9 closure ring, receiving portion and capsule, and FIG. 10 a cross-section through the aperture of the suction hose.

FIG. 1 shows a water pipe 1, also called a shisha or hookah. The construction of the water pipe 1 with its elongated housing 2 and with its modular design is particularly compact. The receptacle 3 is closed at the top by the cover 21. The integral end of a suction hose 22 is connected to the connection piece 23 as part of the cover 21, and is fitted with an interchangeable mouthpiece 24 at the other end. The connection of several hoses is conceivable. The water level for the water held in the receptacle 3 is indicated by 25, since only partial filling of the receptacle 3 is entirely expedient. The on, off and standby switch to operate the shisha 1 is designated by 26. Two capsules with perforations 27 and holding smoking medium are indicated by 10, 10'. The air inlet in the form of several air slots carries the reference marking 28.

Moreover, FIGS. 2 and 3 show a plan view of the heating chamber 4 with suction pipe 6 that is carried in the sleeve-like guide bolt 15.

FIG. 4 represents a cross-section along A-A in FIG. 2. The reference mark 6 designates the suction hose, which can be slid in the direction of the longitudinal axis 8, for which purpose pressure must be applied to the suction hose 6 in the direction of the arrow 40 by hand or by a controller. The suction hose 6 possesses two pipe sections 11 and 12 of different diameters. In this respect, section 12 of the suction hose 6 facing towards the heating chamber 4 has a diameter smaller than that of section 11 pointing towards the receptacle, not shown here, so that a shoulder or end-stop 13 acting against spring 7 forms when the suction hose 6 is moved. Thus the second pipe section 12 is surrounded by the compression spring 7 at its end 16 pointing towards the first pipe section 11, and the spring shaft 18 is integrated into the wall 17 of the heating chamber 4 pointing towards the receptacle.

The fact that the front end 19 of the second pipe section 12 extends into the heating chamber 4 is easily recognisable.

FIG. 5 is an enlargement showing the detail from FIG. 4 with a view of the suction hose 6 and inner tube 14. The latter has a shoulder 13 formed by the inner tube 14 having a diameter at its front end smaller than at its back end, thus forming the spring shaft 18. The fact that the spring is accommodated in the wall 17, which then in turn represents the outer closure of the spring shaft 18, is also easily recognisable in FIG. 5.

FIGS. 6 and 7 then show the consequence of this. FIG. 2 shows a receiving portion 5 for a capsule 10. At the same time, the exactly fitting seat between the side wall 30 of the receiving portion 5 (external) and the wall 31 of capsule 10 is readily recognisable. Both walls 30, 31 extend towards the interior 32 of the heating chamber 4 in the shape of a cone 33, i.e. at a preferred angle $\alpha$ of approx. 7°. At its inner side, the receiving portion 5 comprises an end wall 34 having an opening and extending essentially at right angles to the longitudinal axis 8 of housing 2, and thus also of receiving portion 5. A free space 36 can remain between the end wall 34 of receiving portion 5 and the end wall 35 of the capsule 10. The collar 37, which in turn runs at right angles to the longitudinal axis 8 at the outer side of receiving portion 5, is also easily recognisable. The closure ring 38 is integrated into the housing.

FIG. 7, with reference to FIG. 6, shows the cross-section A-A of the latter, and on the other hand, from the outside to the inside, the components closure ring 38, collar 37, wall 30, 31 (cone), end wall 34 and opening 39.

FIG. 8 shows the detail encircled in FIG. 9, in the form of the integration of the receiving portion into the closure ring 41. The closure ring 41 is connected to the collar 42 on the receiving side. At the same time, capsule 10 lies with its collar 43 in the receiving portion 5, and does so particularly tightly due to the uniform cones/tapers of approx. 7°.

It must also be mentioned that, in order to fit to the closure ring 41, the capsule 10 has, between collar 43 and its actual wall 44, a section 45 in which the wall of capsule 10 runs exactly parallel to the longitudinal axis 46.

As a supplement to this, FIG. 10 shows a cross-section through water pipe 1. In the centre is the housing portion, and below it is the heating chamber with the receiving portion for a capsule and the demountable base plate. When these two components are combined together, a thread automatically ensures the positioning of the centrally positioned valve 48, which sits in the base 54 of the receptacle and extends some distance into the receptacle interior 53. FIG. 10 illustrates the massive, multi-layered construction of the base 54 of the receptacle 3. The opening 57 of the suction hose 6 is secured by three seals in the form of O-rings 49, 50, 51. Valve 48 and suction hose 6 lie in a common longitudinal axis 52. A hollow cavity, integrated into the base 54 and indicated by 55, accommodates a central fastening plate 56 into which the suction hose 6 then actually opens.

The invention claimed is:

1. A water pipe with a housing into which a receptacle intended to be filled with a liquid medium and equipped with at least one suction connection, and a heating chamber which is connected to the receptacle via a suction hose are integrated, whereby the heating chamber comprises a receiving portion for a capsule serving to hold a smoking medium, characterized by the heating chamber comprised in an electronics unit portion of the housing, said electronics unit portion detachably connected to the receptacle and a valve is provided for a portion of the suction hose opening into the receptacle, and a mechanism to eject the capsule from a seat in the receiving portion in a direction opposite to its insertion direction.

2. The water pipe according to claim 1, characterized in that the mechanism is operable from outside the heating chamber.

3. The water pipe according to claim 1, characterized in that the suction hose is supported slidably in the direction of a longitudinal axis.

4. The water pipe according to claim 1, characterized in that the suction hose is supported slidably against a force of a spring.

5. The water pipe according to claim 4, characterized in that a shaft for the spring is integrated into a wall of the heating chamber facing towards the receptacle.

6. The water pipe according to claim 1, characterized in that the suction hose has two sections of different diameter, an inner section and an outer section.

7. The water pipe according to claim 6, characterized in that the inner section of the tube is surrounded by a compression spring.

8. The water pipe according to claim 6, characterized in that the inner section of the suction hose or of an inner tube has a diameter smaller than that of the outer tube section of the suction hose or of the inner tube so as to form a shoulder that acts on the spring when the suction hose is displaced.

9. The water pipe according to claim 6,
characterized in that the inner section of the suction hose or an inner tube extends into the heating chamber.

10. The water pipe according to claim 6,
characterized in that at least one of
the suction hose and the inner tube are slidably supported in a guide bolt connected to the heating chamber.

11. The water pipe according to claim 1,
characterized in that an inner tube with two sections of different diameter is arranged upstream of the suction hose.

12. The water pipe according to claim 1,
characterized in that the mechanism is operable manually or via an electronic controller.

13. The water pipe according to claim 1, wherein the suction hose passes through the electronics unit portion of the housing into the receptacle.

14. The water pipe according to claim 1, wherein the capsule and receiving portion are a firm fit.

15. The water pipe according to claim 14, wherein a lateral wall of the receiving portion tapers conically and the capsule has a corresponding taper.

16. A water pipe with a housing into which a receptacle intended to be filled with a liquid medium and equipped with at least one suction connection, and a heating chamber which is connected to the receptacle via a suction hose are integrated, whereby the heating chamber comprises a receiving portion for a capsule serving to hold a smoking medium,
characterized by
a mechanism to eject the capsule from a seat in the receiving portion in a direction opposite to its insertion direction, and
a closing ring for contact against a collar of the capsule inserted into the receiving portion in use so as to seat the capsule in the receiving portion.

17. A water pipe with a housing into which a receptacle intended to be filled with a liquid medium and equipped with at least one suction connection, and a heating chamber which is connected to the receptacle via a suction hose are integrated, whereby the heating chamber comprises a receiving portion for a capsule serving to hold a smoking medium, the capsule being insertable into the receiving portion in a first direction towards the suction hose,
characterized by
the water pipe comprising a mechanism to eject the capsule from a seat in the receiving portion, the mechanism comprising a compression spring and an end stop acting against the compression spring such that the compression spring is arranged to press the capsule out from the seat in a direction opposite to the first direction.

* * * * *